US008885869B2

(12) United States Patent
Oxford et al.

(10) Patent No.: US 8,885,869 B2
(45) **Date of Patent: *Nov. 11, 2014**

(54) NON-DIRECTIONAL TRANSDUCER

(76) Inventors: J. Craig Oxford, Nashville, TN (US); D. Michael Shields, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/346,353

(22) Filed: Jan. 9, 2012

(65) Prior Publication Data

US 2012/0281870 A1 Nov. 8, 2012

Related U.S. Application Data

(63) Continuation of application No. 11/324,651, filed on Jan. 3, 2006, now Pat. No. 8,094,868.

(51) Int. Cl.

| | |
|---|---|
| ***H04R 1/00*** | (2006.01) |
| *H04R 1/32* | (2006.01) |
| *H04R 7/18* | (2006.01) |
| *H04R 7/12* | (2006.01) |
| *H04R 1/22* | (2006.01) |
| *H04R 1/24* | (2006.01) |
| *H04R 1/26* | (2006.01) |

(52) U.S. Cl.

CPC *H04R 7/12* (2013.01); *H04R 1/323* (2013.01); *H04R 7/18* (2013.01); *H04R 2440/01* (2013.01); *H04R 7/122* (2013.01); *H04R 1/227* (2013.01); *H04R 1/24* (2013.01); *H04R 1/26* (2013.01)

USPC ..... 381/430; 381/423; 181/173; 181/174

(58) Field of Classification Search

USPC ..... 181/173–174; 381/423, 430

See application file for complete search history.

(56) References Cited

U.S. PATENT DOCUMENTS

| | | | | |
|---|---|---|---|---|
| 2,560,379 | A * | 7/1951 | Witchey | 381/430 |
| 3,649,776 | A * | 3/1972 | Burton | 381/342 |
| 4,017,694 | A * | 4/1977 | King | 381/415 |
| 5,148,492 | A * | 9/1992 | Uzawa et al. | 381/177 |
| 5,450,497 | A * | 9/1995 | Paddock | 381/191 |
| 6,980,664 | B2 * | 12/2005 | Goller | 381/186 |

* cited by examiner

*Primary Examiner* — Curtis Kuntz
*Assistant Examiner* — Ryan Robinson
(74) *Attorney, Agent, or Firm* — Wayne Edward Ramage; Baker Donelson

(57) ABSTRACT

A transducer for the creation of acoustic energy omni directionally in a horizontal plane. The transducer includes a base plate, the base plate supporting a centrally located voice coil motor assembly and a hemi-toroidal diaphragm having a proximal edge and a distal edge. The proximal edge is appended to the centrally located voice coil motor assembly and the distal edge is appended to the base plate.

8 Claims, 2 Drawing Sheets

NON-DIRECTIONAL TRANSDUCER

This application is a continuation of, and claims benefit of and priority to, U.S. application Ser. No. 11/324,651, filed Jan. 3, 2006, now issued as U.S. Pat. No. 8,094,868, and is entitled to that filing date for priority. The specification, figures and complete disclosure of U.S. application Ser. No. 11/324,651are incorporated herein by specific reference for all purposes.

TECHNICAL FIELD

The present invention deals with a unique transducer for creating acoustic energy omni directionally in a horizontal plane. The transducer employs bending-wave technology such as to deliver uniform sound pressure in a circular manner. Although the present transducer can be used at a multitude of audio frequency ranges, it is particularly adaptable as a high frequency or tweeter transducer producing acoustic energy above approximately 2500 Hz.

BACKGROUND OF THE INVENTION

There have been a number of suggestions in the art of transducer design in order to make loudspeaker systems more accurate in reproducing audio signals or at least more pleasing to a listener. Such designs include, generally, direct radiators and horns. Direct radiators include electro dynamic, electro static, piezo electric and ionic transducers. Most common among this group are transducers having electro dynamic motor assemblies consisting of a voice coil immersed in a magnetic field used to drive a plastic, paper or metallic diaphragm. When alternating current at audio frequencies is passed through the voice coil of such a transducer, the resulting motion is transferred to the diaphragm which then acts upon the air to produce sound waves. The present invention represents a marked departure from previously available transducer designs but is, generally, a transducer having the above-described electro dynamic motor.

Electro dynamic transducers have been described in the past as those in which the diaphragm is intended to move pistonically or isophasically and those in which the diaphragm is intended to bend, thus not acting as a rigid piston. Electro dynamic transducers in which the diaphragms move pistonically are by far the most commonly employed transducers in the audio industry although actual piston operation is seldom achieved over the entire operating range of the transducer.

Although bending wave transducers have been suggested by a wide variety of manufacturers, their use in the audio industry is rare. Bending wave transducers can generally be divided into categories such as those employing flat diaphragms and those in which the diaphragms are curved. Flat diaphragm devices are exemplified by the products of Mellrichstadt Manger. This transducer was developed by Joseph Manger in the mid 1970's and is currently in commercial production. NXT, a company based in England, has recently done extensive work in what they term a "distributed mode loudspeaker" which employs a flat bending-wave design often using multiple motors with the express objective of producing inherently diffuse radiation.

Curved diaphragm devices, although not as common as transducers employing diaphragms operating pistonically, have been used somewhat successfully in the audio industry. Such curved diaphragm transducers have taken on many forms with respect to both the shape and curvature of the diaphragm as well as the particular configuration of its motor assembly. The most recent evolution of such a product can be found in U.S. Pat. No. 6,061,461 and variations of this curved diaphragm design can be seen in the art cited in the '461 disclosure.

Virtually all curved diaphragm bending wave transducers employ diaphragms curved in only two dimensions. In the 1960's, a third type of bending wave loudspeaker was suggested by Walsh and commercialized as the Ohm loudspeaker. In fact, the Walsh design is currently manufactured by German Physiks. The Walsh transducer employs a diaphragm in the shape of an upright truncated circular cone driven by a voice coil at its small end and terminated at its large end. It has been observed that the cone does not operate as a piston but rather in a bending mode where flexural waves travel down the structure of the cone and the resulting lateral motions of the material caused a radially propagated sound wave.

A further example of a bending-wave transducer was introduced by a German company by the name of MBL. The MBL transducer employs strips or segments oriented vertically and bent. These segments are oriented with respect to one another but not joined. One "pole" of the segments is stationary and the other "pole" is driven by a conventional voice-coil motor. The attempt is to approximate a pulsating sphere. Radiation emanates from this transducer by isophasic motions of the segments.

Although most co only employed transducers employ diaphragms which operate pistonically, there are certain inherent advantages achievable from bending wave transducers. Initially, it is noted that such transducers are not very reactive. As such, once energy is imparted to the diaphragm, it is dissipated in the bending motion rather than being stored. Further, depending upon the exact manner in which force is imparted to the diaphragm, motions of the diaphragm may be made to be mildly chaotic in which case there is some inherent diffuseness to the radiation. This has the desirable effect of allowing a large radiating area without the narrowing of the radiation angle which would normally occur. The large radiating area in turn results in a low surface loudness which is generally associated with the perceptible reports of transparency and clarity of sound emanating from such a transducer.

It has been observed that, particularly at high frequencies, even transducers which are intended to operate pistonically seldom actually achieve isophasic operation. Seeking isophasic behavior has led to extreme design approaches. On the other hand, bending-wave transducers exploit the non-rigidity of the diaphragm material thus working with the material rather than fighting against it.

It is thus an object of the present invention to provide a transducer intended to operate isophasically and yet do so at all frequency ranges, particularly at high frequency.

It is a further object of the present invention to provide a transducer capable of generating acoustic energy omni directionally in a horizontal plane.

These and further objects will be more readily apparent when considering the following disclosure and appended claims.

SUMMARY OF THE INVENTION

The present invention involves a transducer for the creation of acoustic energy omni directionally in a horizontal plane, said transducer comprising a base plate, the base plate supporting a centrally located voice coil motor assembly and a hemi-toroidal diaphragm having a proximal edge and a distal edge. The proximal edge of the diaphragm is appended to the centrally located voice coil motor assembly and the distal edge is appended to the base plate. Ideally, the diaphragm comprises a single sheet of planar material formed to the hemi-toroidal shape which is slit to promote the sheet or planar material retaining the hemi-toroidal shape. Alternatively, the diaphragm can be constructed of a series of truncated wedge-shaped segments joined together to create the hemi-toroidal shape.

DETAILED DESCRIPTION OF THE INVENTION

Figure 1:
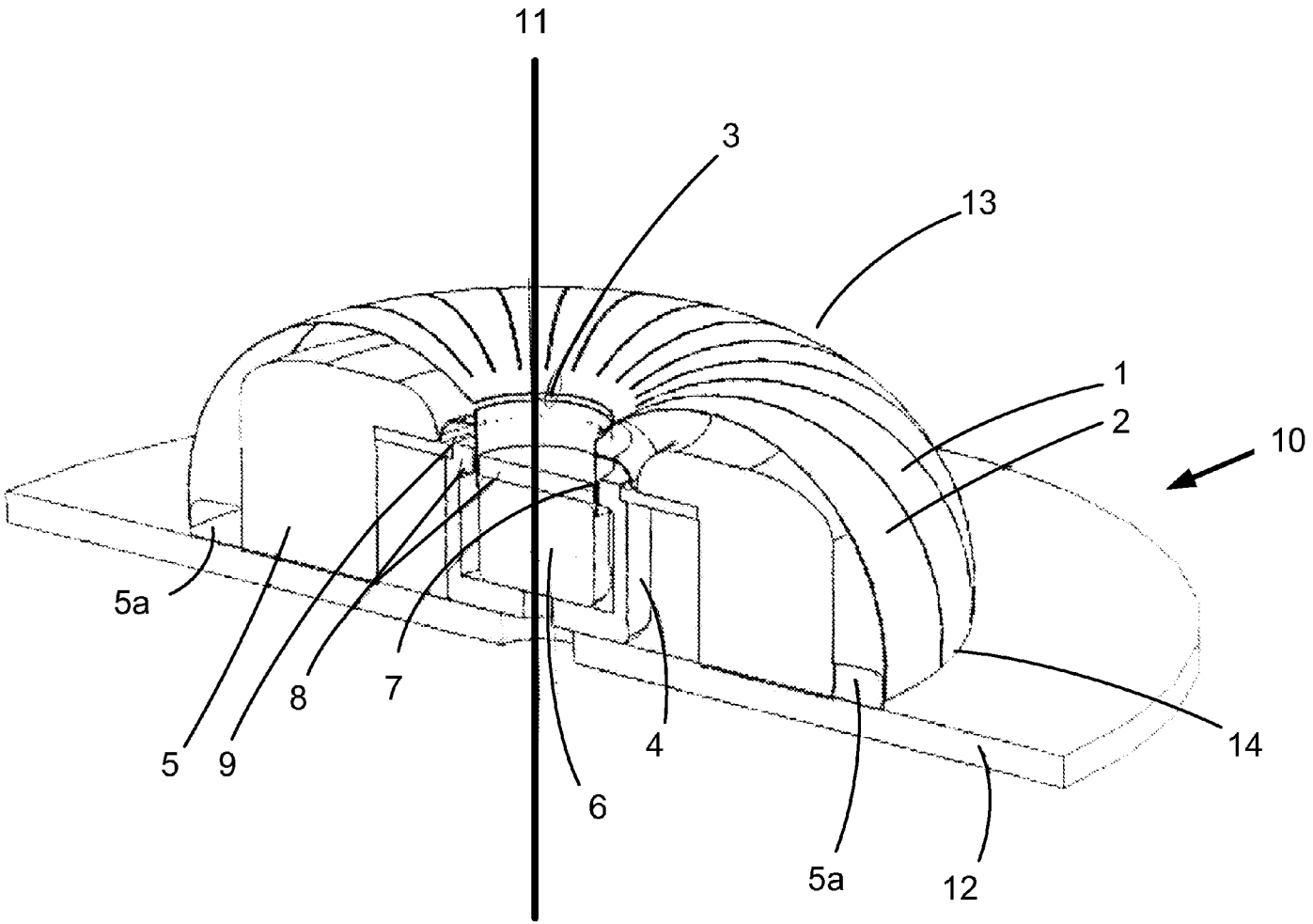
FIG. 1 is a perspective partial cut-away view of the transducer of the present invention.

Turning first to FIG. 1, transducer 10 is shown revealing its various functional elements. This transducer includes base plate 12 acting to support the functional members of this transducer including hemi-toroidal diaphragm 13. Hemi-toroidal diaphragm 13 is shown having a proximal edge 3 and a distal edge 14, the proximal edge being joined to a centrally located voice coil motor assembly (whose description will be made hereinafter), and, at its distal edge 14 to base plate 12.

Hemi-toroidal diaphragm 13 can be composed of any number of materials capable of maintaining a hemi-toroidal shape which are conducive to vibrating in response to the receipt of an appropriate audio signal. Such materials include, metals, for example, aluminum foils and plastics such as Ultem™, a metalized Mylar. Hemi-toroidal diaphragm 13 can be composed of a single sheet of such material which has been slit into segments 1, 2, etc. or from individual flat pieces of die cut film sized to the appropriate truncated wedge shape, such as a trapezoid to resemble segments 1, 2, etc.

The motor assembly of the present invention will now be described. As noted, hemi-toroidal diaphragm 13 is appended, at its proximal end 3 to such assembly. In practice, proximal end 3 is connected to the upper end of the voice call former of this assembly. Voice coil 7 travels freely in magnetic gap 8 which is energized by permanent magnet 6. This magnet is preferably composed of Neodymium, any iron boron alloy to achieve the highest flux density that can be achieved in the smallest motor diameter, 4. The magnetic gap 8 is preferably filled with ferrofluid which is a suspension of magnetizable particles in a viscous fluid, the composition of which is well known to fabricators of such products. This fluid serves three purposes, namely, to promote heat transfer from the voice coil to the outer structure of the motor, to act as a bearing to retain the voice coil centered in the gap and to dampen unwanted resonant motions of the system by added mechanical resistance. Preferably, this assembly also includes suspension 9, often called a "spider," which maintains the correct elevation of voice coil 7 in gap 8. The combination of the magnetic fluid and the inner suspension prevents "wobbling" motions of the voice coil as it moves axially.

Distal end 14 of hemi-toroidal diaphragm 13 terminates on annular protrusion 5*a* at the bottom of damper 5. The damper is die cut from a reticulated foam material, such as polyurethane. It only contacts a diaphragm at the distal ends of the diaphragm segments; otherwise, reticulated foam damper 5 remains clear of the diaphragm and serves to absorb the back wave radiation from the diapragm. In its absence, the back wave would reflect from base plate 12 and be propagated through the diaphragm producing an unwanted response.

It is contemplated that the present transducer 10, as part of a home stereophonic installation be included with other transducers. In this regard, reference is made to FIG. 2 in which loudspeaker 20 employs cabinet 23 supporting low frequency transducer 21, mid-range frequency transducer 22 and the present transducer maintained on a horizontal plane as the high frequency source of acoustic energy emanating from loudspeaker 20. Although not shown, loudspeaker 20 would include audio signal inputs generally located at the rear of cabinet 23 and a cross over network sending audio signals to low frequency transducer 21 generally from approximately 35 to 300 Hz whereupon mid-range frequency transducer creates acoustic energy from approximately 300 Hz to 2500 Hz whereupon the present transducer 10 operates from 2500 Hz to 20 KHz and above.

Figure 2:
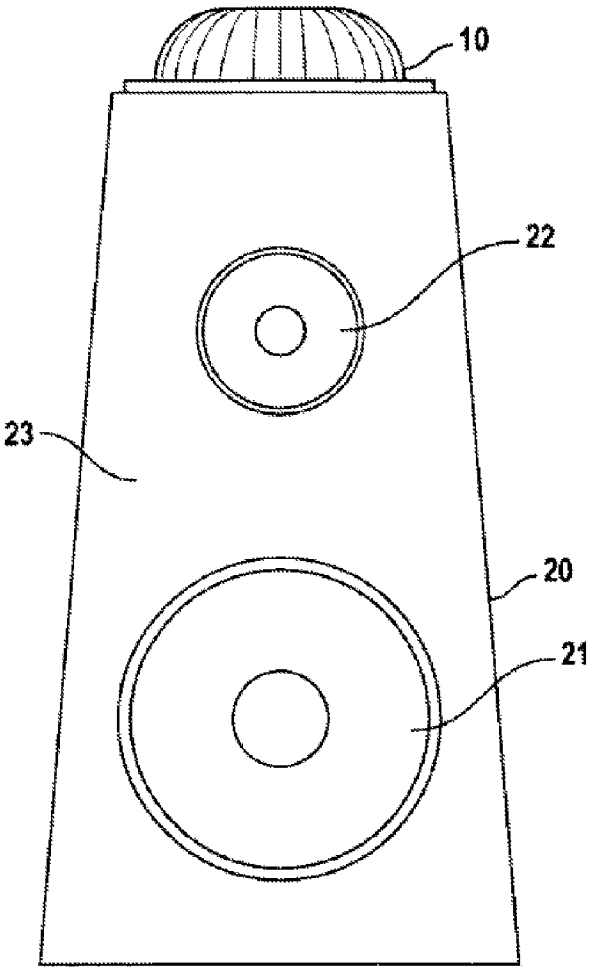
FIG. 2 is a front plan view of a typical speaker system employing the transducer of FIG. 1.

In the configuration shown in FIG. 2, radiation from transducer 10, on axis 11 (FIG. 1) is null. Radiation at 90 degrees to this axis is also null. Radiation in the vertical plane will be uniform from about 5 to 60 degrees to the axis while radiation on the horizontal plane is uniformly circular. Thus, this transducer achieves horizontally o directional distribution of acoustic energy through a solid angle somewhat above its mounting plane.

What is claimed is:

1. A transducer, comprising:

a hemi-toroidal diaphragm with a proximal edge and a distal edge, encompassing a center area without a diaphragm; and a voice coil motor assembly centrally located, wherein said proximal edge of said diaphragm is appended to said voice coil motor assembly;

wherein said diaphragm bends to generate bending-wave acoustic energy, and does not act pistonically.

2. The transducer of claim 1, further wherein said transducer generates bending-wave acoustic energy omni directionally in a plane.

3. The transducer of claim 1, wherein said diaphragm comprises a single sheet of planar material.

4. The transducer of claim 3, wherein said diaphragm comprises a series of radially extending slits.

5. The transducer of claim 1, wherein said diaphragm comprises a series of truncated wedge-shaped segments joined together to create said hemi-toroidal shape.

6. The transducer of claim 1, wherein said voice coil motor assembly comprises a permanent magnet and voice coil establishing a magnetic gap therebetween.

7. The transducer of claim 6, further comprising a suspension for maintaining said voice coil within said magnetic gap.

8. The transducer of claim 6, further comprising a ferrofluid within said magnetic gap.

* * * * *